US009227117B2

(12) United States Patent
Kim et al.

(10) Patent No.: US 9,227,117 B2
(45) **Date of Patent: *Jan. 5, 2016**

(54) ADJUSTABLE IRON-TYPE GOLF CLUB HEAD

(71) Applicant: CALLAWAY GOLF COMPANY, Carlsbad, CA (US)

(72) Inventors: Wee Joung Kim, Vista, CA (US); Homer E. Aguinaldo, Chula Vista, CA (US); James A. Seluga, Carlsbad, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/623,340

(22) Filed: Feb. 16, 2015

(65) Prior Publication Data

US 2015/0157905 A1 Jun. 11, 2015

Related U.S. Application Data

(63) Continuation of application No. 14/305,321, filed on Jun. 16, 2014, now Pat. No. 8,956,243, which is a continuation of application No. 13/833,819, filed on Mar. 15, 2013, now Pat. No. 8,777,774, which is a continuation-in-part of application No. 13/737,555, filed on Jan. 9, 2013, now Pat. No. 8,715,106.

(60) Provisional application No. 61/716,689, filed on Oct. 22, 2012, provisional application No. 61/591,773, filed on Jan. 27, 2012.

(51) Int. Cl.
*A63B 53/06* (2015.01)
*A63B 53/04* (2015.01)

(52) U.S. Cl.
CPC ..... *A63B 53/06* (2013.01); *A63B 53/047* (2013.01); *A63B 2053/0433* (2013.01); *A63B 2053/0454* (2013.01); *A63B 2053/0491* (2013.01); *A63B 2053/0495* (2013.01)

(58) Field of Classification Search
CPC ..... A63B 53/06; A63B 53/047; A63B 2053/0433; A63B 2053/0491
USPC ..... 473/334–339, 342, 344, 348, 349
See application file for complete search history.

(56) References Cited

U.S. PATENT DOCUMENTS

| | | | | |
|---|---|---|---|---|
| 5,050,879 | A * | 9/1991 | Sun et al. | 473/338 |
| 8,777,774 | B1 * | 7/2014 | Kim et al. | 473/336 |
| 2011/0152001 | A1 * | 6/2011 | Hirano | 473/337 |
| 2011/0172026 | A1 * | 7/2011 | Cackett et al. | 473/331 |

* cited by examiner

*Primary Examiner* — Benjamin Layno
(74) *Attorney, Agent, or Firm* — Rebecca Hanovice; Michael Catania; Sonia Lari

(57) ABSTRACT

The present invention discloses an iron-type golf club head having features that permit adjustment to the principal moment of inertia angle, the center of gravity location, turf interaction, loft, and overall club forgiveness. In particular, the golf club head includes a rear cavity sized to receive a weight cartridge composed of one or more materials, the adjustment of which changes one or more of the mass properties of the golf club head and also changes the interaction of the golf club head with turf during play. The weight cartridge may comprise one or more high density materials, and may be located in or proximate the sole.

11 Claims, 5 Drawing Sheets

ADJUSTABLE IRON-TYPE GOLF CLUB HEAD

CROSS REFERENCES TO RELATED APPLICATIONS

The present application is a continuation of U.S. patent application Ser. No. 14/305,321 filed on Jun. 16, 2014, and issued on Feb. 17, 2015 as U.S. Pat. No. 8,956,243, which is a continuation of U.S. patent application Ser. No. 13/833,819, filed on Mar. 15, 2013, and issued on Jul. 15, 2014 as U.S. Pat. No. 8,777,774, which is a continuation-in-part of U.S. patent application Ser. No. 13/737,555, filed on Jan. 9, 2013, and issued on May 6, 2014, as U.S. Pat. No. 8,715,106, which claims priority to U.S. Provisional Patent Application No. 61/591,773, filed on Jan. 27, 2012, the disclosure of which is hereby incorporated by reference in its entirety herein, and to U.S. Provisional Patent Application No. 61/716,689, filed on Oct. 22, 2012, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to an adjustable iron-type golf club head. More specifically, the present invention relates to an iron-type golf club head with features that allow for the adjustment of the principal moment of inertia angle and/or turf interaction, including an adjustable weight cartridge or an adjustable sole plate and a lightweight face.

2. Description of the Related Art

The prior art discloses various types of golf club heads having preferred moments of inertia characteristics. In particular, U.S. Pat. No. 6,045,455, entitled "Inertially tailored golf club heads," the disclosure of which is hereby incorporated in its entirety herein, and U.S. Pat. No. 6,186,905, entitled "Methods for designing golf club heads," the disclosure of which is hereby incorporated in its entirety herein, are both related to methods for designing inertially tailored golf club heads. The prior art does not, however disclose optimized, adjustable irons that permit a user to tailor the moment of inertia or center of gravity characteristics of his or her club.

Furthermore, traditional iron-type golf clubs include faces made of metal materials, and usually the same material as the rest of the iron body. This reduces the amount of discretionary weight available to manufacturers, which they otherwise would be able to use to adjust characteristics of the golf club head like moment of inertia and center of gravity location.

BRIEF SUMMARY OF THE INVENTION

The present invention provides an iron-type golf club with features that allow for the adjustment of mass properties such as one or more moment of inertia angles, the location of the center of gravity, and the weight of the golf club head.

One aspect of the present invention is an iron-type golf club head comprising a weight cartridge that adjusts the mass properties of the iron. In particular, changing the orientation of the weight cartridge with respect to the head changes one or more of the mass properties of the head. The weight cartridge may also affect the overall weight of the head. In some embodiments, the cartridge includes one or more sole surface features that affect the interaction of the head with the turf during play. In each of the embodiments disclosed, the weight cartridge is detachable and can be semi-permanently affixed to the golf club head.

Another aspect of the present invention is an iron-type golf club head comprising a body having a top portion, a sole portion, a heel, a toe, a face, and a rear cavity located proximate the sole portion, and a weight cartridge composed of at least one high density material and at least one low density material, wherein the weight cartridge has an asymmetric shape along at least one axis, wherein the weight cartridge is sized to fit within the rear cavity, and wherein changing the orientation of the weight cartridge within the rear cavity changes at least one principal moment of inertia angle or location of the golf club head center of gravity. The weight cartridge may have a middle portion and two end portions, one or both of which may be disposed at an angle with respect to the middle portion.

In some embodiments, the middle portion may be composed of a low density material such as composite and one or both of the end portions may be composed of a high density material such as tungsten alloy. In other embodiments, the middle portion may be composed of a high density material such as tungsten alloy and one or both of the end portions may be composed of a low density material such as composite. In some embodiments, the weight cartridge may be removably secured within the rear cavity with a mechanical fastener or a semi-permanent adhesive material. In some embodiments, the weight cartridge affects interaction of the golf club head with turf during play, and replacing the weight cartridge with a second weight cartridge having a different shape or profile may change the interaction of the golf club head with the turf during play.

Yet another aspect of the present invention is a golf club head comprising a body comprising a top rail, a sole, a hosel, a heel, and a toe, a face plate composed of a lightweight material having a first density, and a weight insert, wherein the body is composed of a metal material having a second density that is greater than the first density. In some embodiments, the lightweight material may be a composite, the body may be composed of steel, and the weight insert may be composed of a tungsten alloy. In other embodiments, golf club head may comprise a recess sized to receive the weight insert, which may be permanently or removably fixed within the recess, and the recess may be located proximate or in the sole. In some embodiments, the golf club head may be an iron-type golf club head, such as a wedge. In some further embodiments, the heel may be squared and the toe may be flat, such that the golf club head has a low center of gravity. In other embodiments, the face plate may comprise grooves, which may be co-molded in the face plate from a metal material, such as titanium, if the face plate is composed of a plastic or composite material.

Another aspect of the present invention is an iron-type golf club head comprising a metal body comprising a sole, a top rail, a heel, a toe, and a hosel, a composite face plate comprising a plurality of grooves, and a tungsten weight insert, wherein the sole comprises a recess sized to receive the weight insert, and wherein the weight insert is welded within the recess. In some embodiments, the toe and heel may be squared. In other embodiments, the plurality of grooves may be co-molded with the face plate from a titanium alloy. In other embodiments, the body may be composed of a steel material, and the body may also have a low center of gravity.

Yet another aspect of the present invention is an iron-type golf club head comprising a steel body comprising a sole, a top rail, a heel, a toe, and a hosel, a composite face plate comprising a plurality of grooves, and a high-density weight insert, wherein the sole comprises a recess sized to releasably receive the weight insert, and wherein the plurality of grooves is co-molded with the face plate from a titanium alloy. The weight insert may be composed of a tungsten alloy, and may be secured within the recess with a screw. In alternative embodiments, the weight insert may be composed of multiple materials, such that changing the orientation of the weight insert within the recess alters one or more mass properties of the golf club head.

Another aspect of the present invention is an iron-type golf club head comprising a body having a top portion, a sole portion, a heel, a toe, and a face, and a weight cartridge composed of at least one high density material and at least one low density material, wherein the sole comprises a recess, wherein the weight cartridge has an asymmetric shape along at least one axis, wherein the weight cartridge is sized to at least partially fit within the recess, and wherein changing the orientation of the weight cartridge within the recess changes the interaction of the golf club head with turf during play. In some embodiments, the weight cartridge may be approximately cylindrical. In other embodiments, the weight cartridge may be composed of at least two different materials having different densities. In a further embodiment, the weight cartridge may comprise a middle portion composed of a first material, a first end portion composed of a second material, and a second end portion composed of a third material. In some further embodiments, the middle portion may have a greater diameter than that of the first and second end portions, and in others the first material may have a higher density than the second material. In one embodiment, the first material may be a tungsten alloy. In some embodiments, the weight cartridge may be removably secured within the recess with at least one screw. In some embodiments, changing the orientation of the weight cartridge within the recess may change at least one mass property selected from the group consisting of a principal moment of inertia angle and a center of gravity Yet another aspect of the present invention is an iron-type golf club head comprising a body comprising a top rail, a hosel, a heel, a toe, and a face, and an adjustable sole piece, wherein the adjustable sole piece is movably affixed to the body, and wherein changing the orientation of the adjustable sole piece changes the interaction of the golf club head with turf during play. In some embodiments, the adjustable sole piece may be affixed to the body with at least one screw. In other embodiments, the iron-type golf club head may further comprise a screw, the adjustable sole piece may comprise a screw receiving portion and a flange portion, and the screw may attach the screw receiving portion to the body. In some embodiments, the adjustable sole piece may comprise a first position and a second position, such that the flange may be approximately parallel with the face in the first position, and the flange may be approximately perpendicular to the face in the second position. In a further embodiment, the golf club head may have a sole portion with a greater width when the adjustable sole piece is in the second position. In some embodiments, the adjustable sole piece may be composed of at least two different materials.

Another aspect of the present invention is an iron-type golf club head comprising a body comprising a sole, a top rail, a heel, a toe, and a hosel, a composite face component comprising a plurality of grooves, and a movable sole piece, wherein the sole comprises a recess sized to releasably receive at least a part of the movable sole piece, and wherein the plurality of grooves is co-molded with the face plate from a metal material. In some embodiments, changing the orientation of the movable sole piece within the recess may change at least one mass property selected from the group consisting of a principal moment of inertia angle and a center of gravity. In other embodiments, at least a part of the movable sole piece may be secured within the recess with a screw. In some embodiments, the movable sole piece may have an asymmetric shape along at least one axis. In still other embodiments, the composite face component may be selected from the group consisting of a face plate and a face insert.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
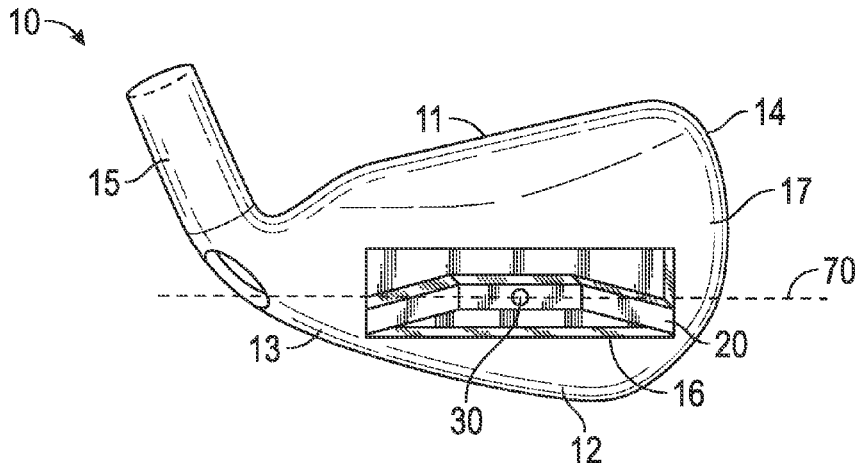
FIG. 1 is a rear perspective view of a first embodiment of the present invention.

A first embodiment of the iron-type golf club head 10 of the present invention is shown in FIG. 1. The golf club head 10 has a top portion 11 (also called a top rail), a sole portion 12, a heel portion 13, a toe portion 14, a hosel 15, a face (not shown), and a cavity 16 on the rear side 17 proximate the sole portion 12. A weight cartridge 20 is disposed within the cavity 16 and affixed to the golf club head 10 with a mechanical fastener 30 such as a screw, though in alternative embodiments the weight cartridge 20 may be semi-permanently disposed within the cavity 16 by any means known to a person of ordinary skill in the art, such as via clips or semi-permanent adhesive. The weight cartridge 20 can be composed of any number of materials, and preferably is asymmetric along at least one axis 70. In this embodiment, when the weight cartridge 20 is disposed within the cavity 16, both the principal moment of inertia (MOI) angle and the center of gravity (CG) location of the golf club head 10 differ from the principle MOI angle and CG of the golf club head 10 when the weight cartridge 20 is not disposed within the cavity 16.

Figure 2:
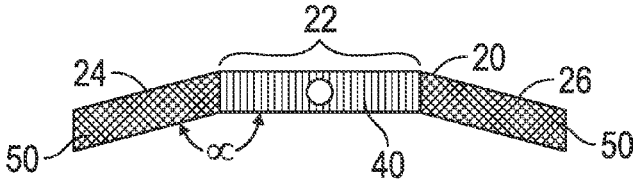
FIG. 2 is a plan view of a first weight cartridge.
Figure 3:
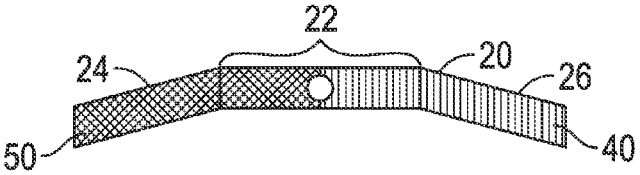
FIG. 3 is a plan view of a second weight cartridge.
Figure 4:
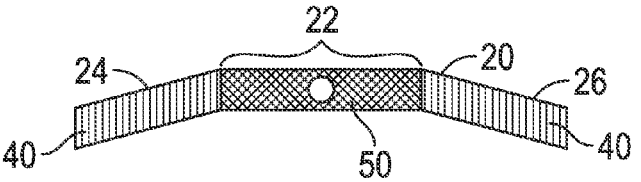
FIG. 4 is a plan view of a third weight cartridge.
Figure 5A:
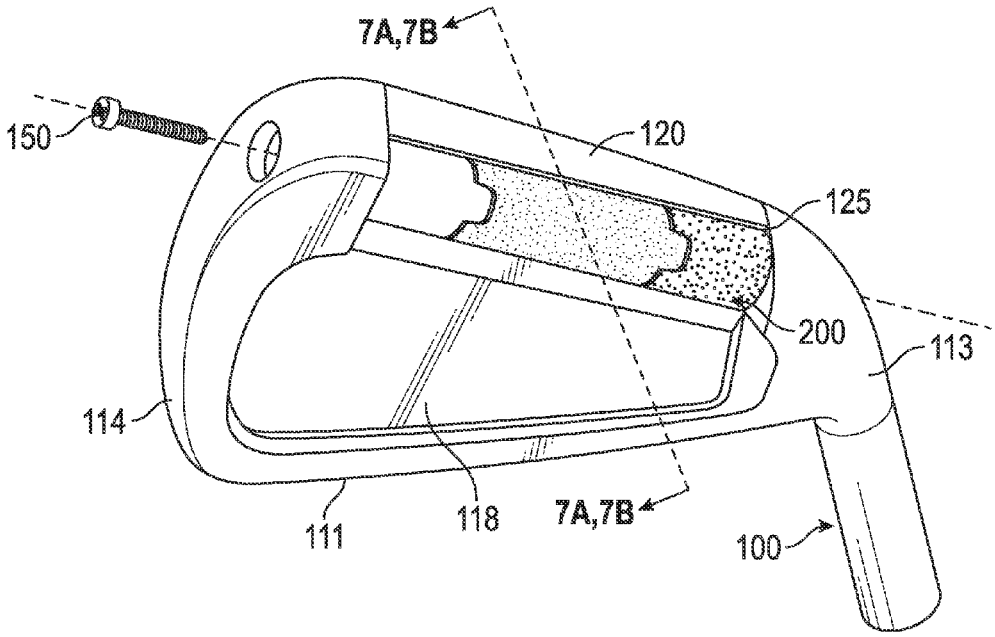
FIG. 5A is a rear perspective view of a second embodiment of the present invention.
Figure 5B:
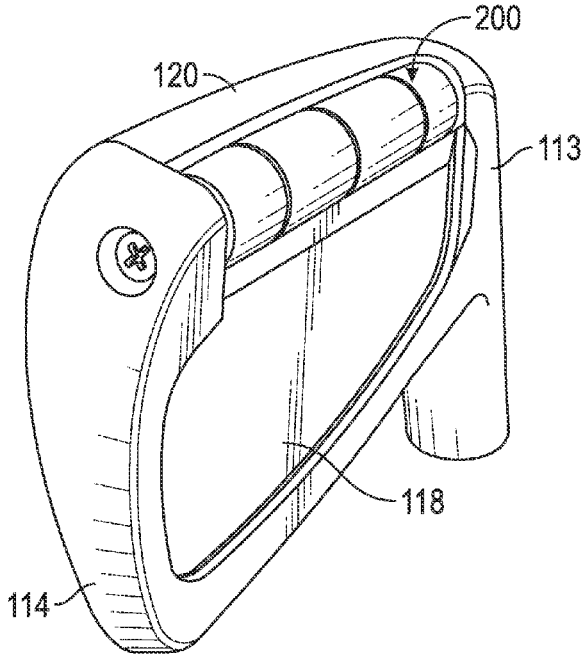
FIG. 5B is a side perspective view of the embodiment shown in FIG. 5A.

As shown in FIGS. 2-4, the weight cartridge 20 may be made of multiple materials, or it may be made of a single material. In the embodiment shown in FIG. 2, the weight cartridge 20 has a middle portion 22 composed of one or more low density materials 40, such as plastic or composite, and two end portions 24, 26 disposed at an angle $\alpha$ with respect to the middle portion 22 and composed of one or more high density materials 50, such as a tungsten alloy. In an alternative embodiment, shown in FIG. 3, the weight cartridge 20 is evenly divided between low and high density materials 40, 50. In yet another embodiment, the middle portion 22 of the weight cartridge 20 is composed of one or more high density materials 50 and the end portions 24, 26 are composed of one or more low density materials 40. In the first embodiment, the middle portion 22 is composed of plastic and the end portions 24, 26 are composed of a tungsten alloy, but in alternative embodiments the end portions 24, 26 may be composed of two different high density materials.

The magnitude of the angle $\alpha$ affects the change in MOI and CG in the golf club head 10 when the weight cartridge 20 is adjusted or replaced with a weight cartridge 20 having a different material configuration. In order to adjust MOI angle and CG location in the preferred embodiment of the present invention, the mechanical fastener 30 is loosened and the weight cartridge 20 is flipped so that the end portions 24, 26 point upwards toward the top portion 11 instead of downwards towards the sole portion 12. Alternatively, the weight cartridge 20 may be removed and replaced with a weight cartridge 20 having a different material composition or a different angle $\alpha$ between the end portions 24, 26 and the middle portion 22. In another embodiment, the weight cartridge 20 may be adjusted so that the end portions 24, 26 point towards the heel portion 13 or toe portion 14 of the golf club head 10. Through the use of one or more of the weight cartridges 20, 200 disclosed herein, the adjustment of the moment of inertia angle leads to a greater increase in the forgiveness of the iron-type golf club head 10 than a change to the draw/fade bias of the iron, without requiring a change to the overall structure of the golf club head 10.

Figure 6A:
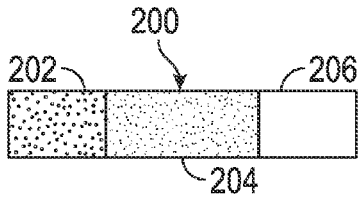
FIG. 6A is a side, plan view of the weight cartridge shown in FIG. 5A.
Figure 6B:
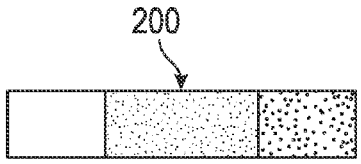
FIG. 6B is a side, plan view of the weight cartridge shown in FIG. 5A in a different orientation.

The location of the weight cartridge 20 near the sole portion 12 of the golf club head 10 also preferably is designed to affect the interaction of the golf club head 10 with turf during play. For example, in the preferred embodiment of the present invention, shown in FIGS. 5A-7B, an iron-type golf club head 100 comprises a top rail 111, heel 113, toe 114, face 160, and sole portion 120, as well as a tubular recess 125 in the sole portion that extends into a rear cavity of the golf club head 10 but, in alternative embodiments, may be contained entirely within the sole portion 120. The preferred embodiment also includes a cylindrical weight cartridge 200, which preferably includes three sections: a first end section 202, a middle section 204, and a second end section 206. As shown in FIGS. 6A and 6B, the orientation of the weight cartridge 200 within the recess 125 affects the mass properties of the club iron-type golf club head 100, with the orientation shown in FIG. 6A causing neutral weighting and the orientation shown in FIG. 6B causing draw weighting.

Figure 7A:
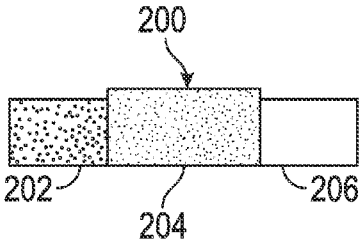
FIG. 7A is a side, plan view of the weight cartridge shown in FIG. 5A in another orientation and a cross-sectional view of the embodiment shown in FIG. 5A along lines 7A,7B-7A, 7B.
Figure 7A:
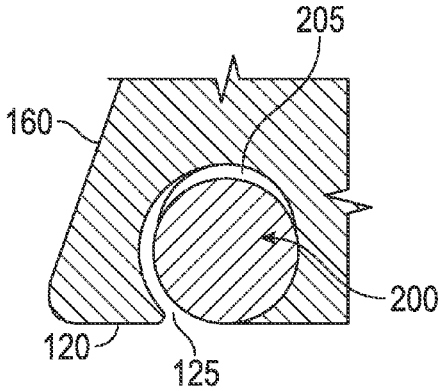
Figure 7B:
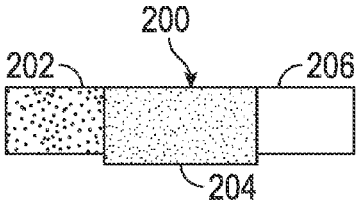
FIG. 7B is a side, plan view of the weight cartridge shown in FIG. 5A in yet another orientation and a cross-sectional view of the embodiment shown in FIG. 5A along lines 7A,7B-7A,7B.
Figure 7B:
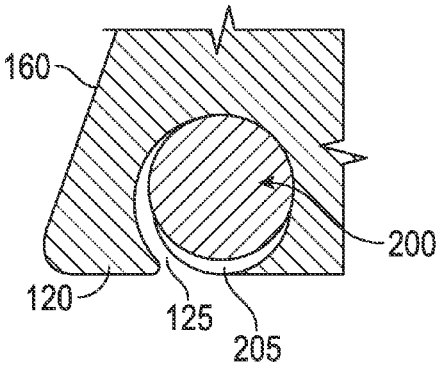
Figure 8A:
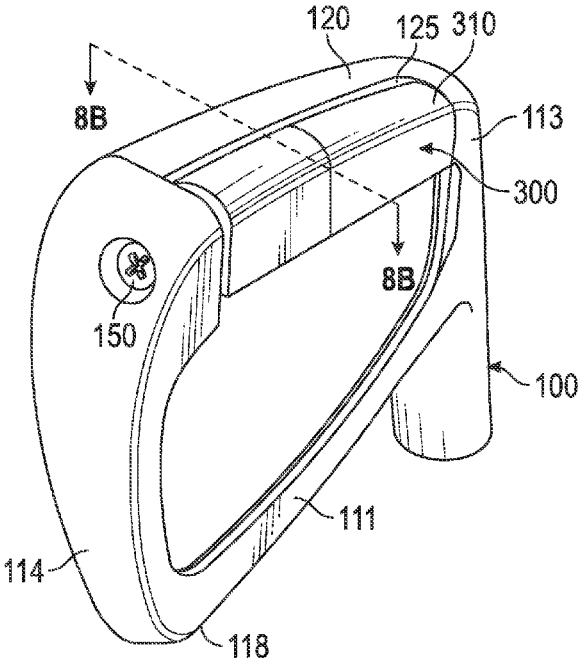
FIG. 8A is a side perspective view of a third embodiment of the present invention with an adjustable sole piece in a first orientation.
Figure 8B:
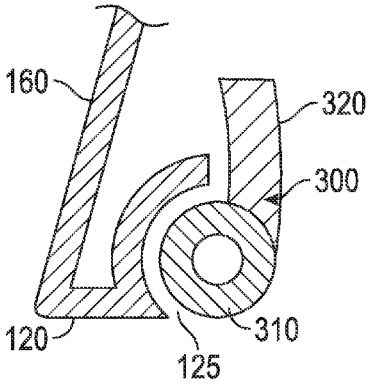
FIG. 8B is a cross-sectional view of the embodiment shown in FIG. 8A along lines 8B-8B.

As shown in FIGS. 7A and 7B, the orientation of the weight cartridge 200 also affects the interaction between the golf club head 100 and the turf or ground surface. In the preferred embodiment, the middle section 204 of the weight cartridge has a diameter that is greater than that of the first and second end sections 202, 206, and is slightly offset from the first and second end sections 202, 206 so that the middle section 204 protrudes slightly from one side of the weight cartridge 200. When the protruding part 205 of the middle section 204 faces upward into the body of the golf club head 100, the golf club head has a different loft than when the protruding part of the middle section 204 faces downwards into the turf. In this way, turf interaction can be altered by changing the orientation of the weight cartridge 200, and can further be altered by replacing the weight cartridge 200 with a different weight cartridge 200 having a different shape or turf interaction profile. The weight cartridge 200 can be retained within the recess 125 by any means known to a person skilled in the art, but preferably is removably secured within the recess 125 with at least one screw 150.

Another embodiment of the present invention, shown in FIGS. 8A through 9B, also includes a feature that allows a golfer to adjust the turf interaction provided by his or her golf club head 100. In this embodiment, the golf club head 100 has a similar structure to that of the preferred embodiment shown in FIGS. 5A through 7B, but instead of a weight cartridge 200, the golf club head includes an adjustable sole piece 300 having a screw receiving portion 310, which is affixed within the recess 125 of the sole portion 120, and a flange portion 320 that extends away from the screw receiving portion 310. As in the preferred embodiment, the adjustable sole piece 300 can be retained within the recess 125 by any means known to a person skilled in the art, but preferably is removably secured within the recess 125 with at least one screw 150.

Figure 9A:
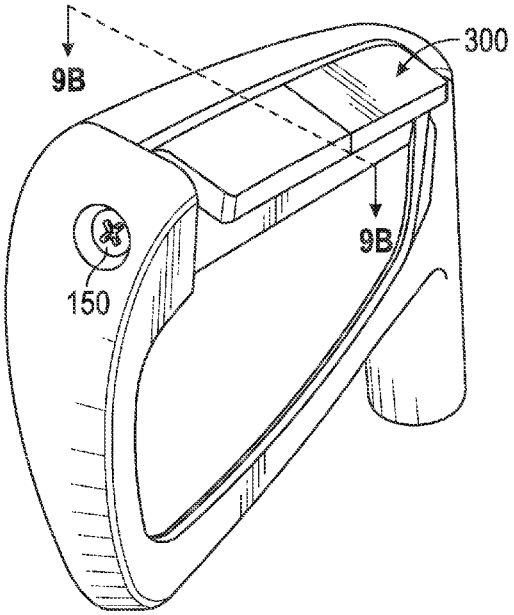
FIG. 9A is a side perspective view of the third embodiment shown in FIG. 8A with the adjustable sole piece in a second orientation.
Figure 9B:
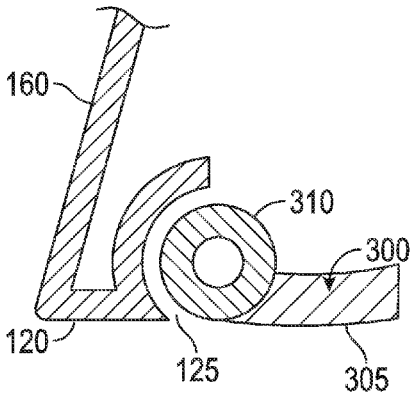
FIG. 9B is a cross-sectional view of the embodiment shown in FIG. 9A along lines 9B-9B.

As shown in FIGS. 8A through 9B, adjusting the orientation of the flange portion 320 changes the overall width of the sole of the golf club head 100. When in the configuration shown in FIGS. 8A and 8B, and the flange portion 320 is approximately parallel with the face 160, the golf club head 100 has a narrow sole, and much less turf interaction. When the adjustable sole piece 300 is adjusted so that the flange portion 320 is approximately perpendicular to the face 160 as shown in FIGS. 9A and 9B, the sole width is much increased. The flange portion 320 may further include texturing or other features on its outermost surface 325 to further affect the interaction between the golf club head 100 and the turf. In other embodiments, the adjustable sole piece 300 may make up the entirety of the sole of the golf club head 100, such that the golf club head 100 has no sole portion 120 when the adjustable sole piece 300 is removed from the golf club head 100. In these embodiments, the adjustable sole piece 300 is affixed directly to the heel and toe portions 113, 114 of the golf club head 100 and may make contact with the face 160.

Figure 10:
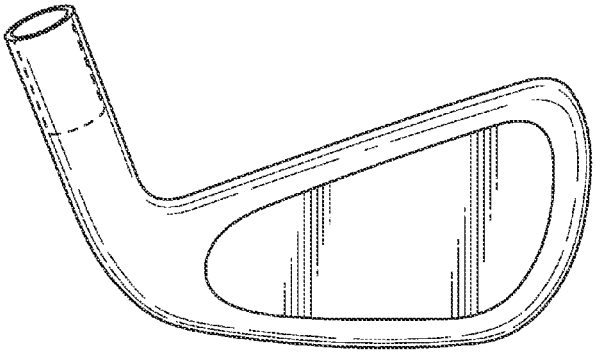
FIG. 10 (Prior Art)
FIG. 10 is a rear, plan view of a prior art, iron-type golf club head

Traditional golf clubs, and particularly iron-type golf clubs such as the prior art club shown in FIG. 10, have faces that are formed from one or more metal materials. In particular, iron-type golf club heads are made from various types of steel. This material is heavy and dense and causes the center of gravity (CG) of the club to be relatively high, thus making it more difficult for golfers to hit a golf ball into the air. In another embodiment of the present invention, the golf club head 10 comprises features that contribute to a lower center of gravity, which improves a golfer's ability to connect with a golf ball and get it airborne, and which, when combined with the weight cartridges 20, 200 shown in FIGS. 1-7B, allow for more significant adjustment of the golf club's mass properties.

Figure 11:
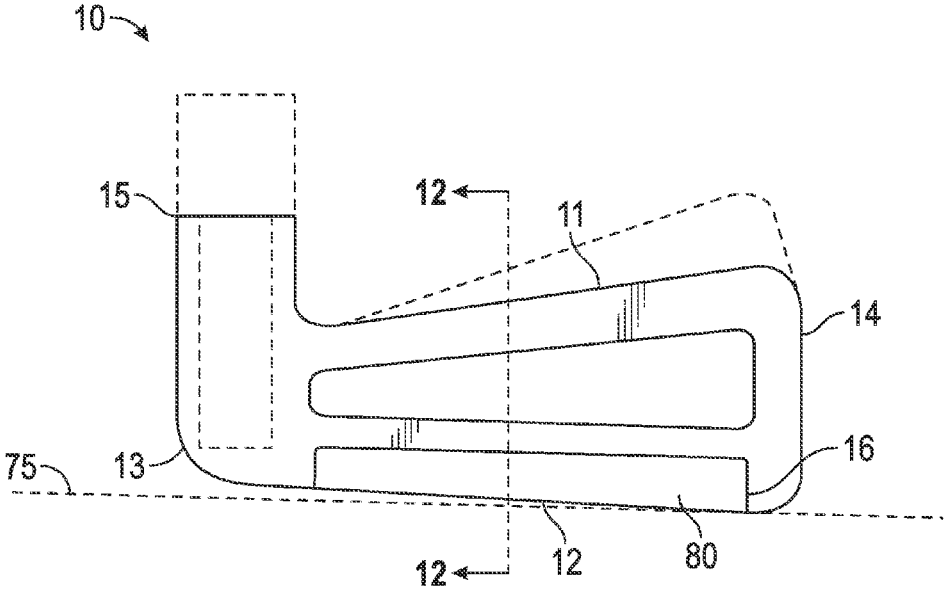
FIG. 11 is a rear, plan view of a fourth embodiment of the present invention.
Figure 12:
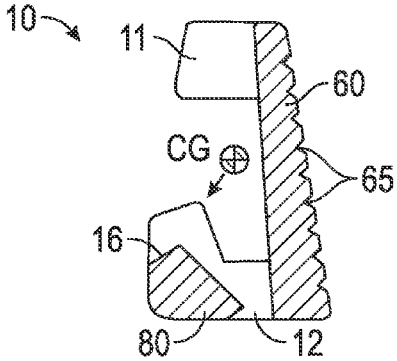
FIG. 12 is a cross-sectional view of the embodiment shown in FIG. 11 along lines 12-12.

In particular, FIGS. 11-12 show a second embodiment of the present invention Like the embodiment shown in FIG. 1, the golf club head 10 comprises a top portion 11, a sole portion 12, a heel portion 13, a toe portion 14, and a hosel 15. In contrast with the prior art golf club shown in FIG. 10, and the embodiments shown in FIG. 1, the golf club head 10 shown in FIGS. 11 and 12 has a squarer heel portion 13 that makes greater contact with a ground plane 75, thus allowing the hosel 15 to be located lower to the ground. The golf club head 10 shown in FIGS. 11 and 12 also includes a flatter, squarer toe portion 14 that is closer to the ground than the toe portion 14 of prior art clubs. These inventive features move more material towards the ground plane 75, thus lowering the CG of the golf club head 10.

The golf club head 10 shown in FIGS. 11 and 12 also comprises a low-weight face plate 60, which is preferably formed from a high-strength composite material but may, in alternative embodiments, be made of plastic or low-density metal alloys. Grooves 65 are preferably co-molded into the face plate 60 from a high-strength metal alloy such as titanium. The golf club head 10 also includes a cavity 16 proximate the sole portion 12 that may be sized to receive the weight cartridge 20 shown in FIGS. 2-7B, or can be sized to receive a high-density insert 80, which preferably is composed of a tungsten material but may, in alternative embodiments, be composed of other high-density or high-weight materials. The high-density insert 80 may be removable or may be permanently affixed to the cavity 16 by welding, adhesive, or some other mechanism such as a bolt or screw. The combination of the weight cartridge 20 or high-density insert 80 and the low-weight face plate 60 shifts the center of gravity towards the ground, thus increasing a golfer's ability to get a golf ball airborne.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising:

a body comprising a top rail, a sole, a hosel, a heel, and a toe;

a face component; and an adjustable sole piece comprising cylindrical weight cartridge, wherein the cylindrical weight cartridge is composed of at least one high density material and at least one low density material, wherein the sole comprises a tubular recess extending from the heel to the toe that is sized to releasable receive at least a portion of the cylindrical weight cartridge of the adjustable sole piece, wherein the adjustable sole piece is movably affixed to the body within the recess, wherein at least a portion of the adjustable sole piece is exposed to an exterior of the golf club head, wherein the exposed portion of the adjustable sole piece makes contact with turf when the golf club head is placed at address, and wherein changing the orientation of the adjustable sole piece changes the interaction of the golf club head with the turf during play.

2. The iron-type golf club head of claim 1, wherein the cylindrical weight cartridge comprises a middle portion composed of a first material, a first end portion composed of a second material, and a second end portion composed of a third material.

3. The iron-type golf club head of claim 2, wherein the middle portion has a greater diameter than that of the first and second end portions.

4. The iron-type golf club head of claim 2, wherein the first material has a higher density than the second and third materials.

5. The iron-type golf club head of claim 2, wherein the first material is a tungsten alloy.

6. The iron-type golf club head of claim 1, wherein changing the orientation of the adjustable sole piece with respect to the body changes at least one mass property selected from the group consisting of a principal moment of inertia angle and a center of gravity.

7. The iron-type golf club head of claim 1, wherein the face component is composed of a composite material.

8. The iron-type golf club head of claim 7, wherein the face component is selected from the group consisting of a face plate and a face insert.

9. The iron-type golf club head of claim 7, wherein the face component comprises a plurality of grooves, and wherein the plurality of grooves is co-molded with the face from a metal material.

10. The iron-type golf club head of claim 9, wherein the metal material is titanium.

11. The iron-type golf club head of claim 1, wherein at least a part of the adjustable sole piece is secured to the body with a screw.

* * * * *